United States Patent [19]

Igielska

[11] Patent Number: 4,625,670

[45] Date of Patent: Dec. 2, 1986

[54] SHIP FOR CARRYING STANDARIZED CARGO UNITS

[75] Inventor: Jadwiga Igielska, Lerum, Sweden

[73] Assignee: Trans Consultants AB, Gothenburg, Sweden

[21] Appl. No.: 683,359

[22] Filed: Dec. 19, 1984

[51] Int. Cl.[4] ..... B61D 3/16

[52] U.S. Cl. ..... 114/78; 114/75; 410/40; 220/22.3; 220/22.5

[58] Field of Search ..... 114/72, 75, 76, 77 R, 114/78, 258–360; 410/32, 39, 38, 40, 122–124; 414/137–139; 220/22, 22.1, 22.2, 22.3, 22.5

[56] References Cited

U.S. PATENT DOCUMENTS

| | | | |
|---|---|---|---|
| 3,481,298 | 12/1969 | Dluhy | 114/72 |
| 3,552,345 | 1/1971 | Harlander et al. | 114/72 |
| 3,596,755 | 8/1971 | Bundy | 410/40 |
| 3,784,054 | 1/1974 | Mautz | 220/22.3 |
| 3,878,942 | 4/1975 | Hansen | 410/40 |
| 3,921,538 | 11/1975 | Bundy | 105/367 |
| 3,955,676 | 5/1976 | Hansen et al. | 206/451 |
| 4,013,018 | 3/1977 | Hansen | 410/40 |
| 4,067,630 | 1/1978 | Stark | 220/22.3 |
| 4,283,083 | 8/1981 | Johnson | 220/22.3 |
| 4,325,667 | 4/1982 | Freeman | 414/139 |

FOREIGN PATENT DOCUMENTS

| | | | |
|---|---|---|---|
| 52-20584 | 2/1977 | Japan | 114/75 |
| 307520 | 1/1969 | Sweden | 114/75 |
| 364482 | 2/1974 | Sweden | 114/75 |
| 1188316 | 4/1970 | United Kingdom | 114/75 |
| 1232306 | 5/1971 | United Kingdom | 114/75 |

*Primary Examiner*—Trygve M. Blix
*Assistant Examiner*—C. Bartz
*Attorney, Agent, or Firm*—Holman & Stern

[57] ABSTRACT

The deck of a container ship is provided with longitudinally running rails carrying cassettes adapted to support standarized cargo units, such as containers, for example. Each cassette includes transverse front and rear guide members each having vertical guide bars on both of its transverse faces. By spacing the cassettes apart longitudinally, two cassettes may, between themselves, support a further stack of containers. In use, each cassette is locked in relation to the deck, longitudinally as well as transversely.

10 Claims, 8 Drawing Figures

SHIP FOR CARRYING STANDARIZED CARGO UNITS

BACKGROUND OF THE INVENTION

1. Field of the Invention

This invention relates to cassette structures movably supported on the deck of a cargo vessel for holding shipping containers within each cassette and between spaced cassettes.

2. Description of the Prior Art

One problem in designing certain types of ships lies in making them adaptable to various kinds of cargoes, while ensuring an economic operation and an easy handling of the cargo. Much cargo is now made up into units of standardized size, mostly containers, but also flatracks and similar devices. These units may be stowed in cells formed by vertical guides arranged in the cargo holds, as well as upon the weather deck. A desire is to design these guides so they form a strong structure, reducing the inclusion of carrying members in the ships hull.

Many containers and similar cargo units have a length of 20′ or 40′, while the breadth and height are substantially alike. Conventional "cellguide" systems are often designed for a certain length of container, but attempts have been made to provide flexibility with respect to container length.

British Pat. No. 1 232 306 shows one solution where vertical support and guide members are movable as a unit which can be placed in attachment means at positions corresponding to desired container sizes, other solutions of similar nature are shown e.g. in British No. 1 188 316 and in U.S. Pat. No. 3,552,345.

A drawback with these designs is that guides at one end of a container stack are attached to the ship, separately from the guides at the opposite end of the stack. This necessitates strong members at the points of attachments at the hull.

The shifting of these guides requires considerable lifting facilities, either on board, or at a quay, and every re-disposition to suit a change in size will take up valuable time.

SUMMARY OF THE INVENTION

An object of the present invention is to offer a guide system, which makes possible a re-disposition of the cargo reception space by using equipment available on board and with small loss of time.

The invention thus relates to a ship having at least one deck for carrying standardized cargo units stacked vertically betwen guide members. The deck is provided with rails running in the longitudinal direction of the ship, and a forward and a rearward guide member are interconnected by longitudinal stays to form a cassette having a length suited to receive one size of standardized cargo units. The cassette is provided with wheels or other friction reducing means for movement along the rails and is provided with means for locking it in any selected position along the rails.

The deck may be devoid of hatch openings, or may have openings closable by horizontally sliding covers. There is no need for aligning the guides upon the deck with guides in spaces therebelow, which provides a considerable freedom of moving the cassettes along the deck.

The cassette is, in itself, a strong unit and holds the stacked containers well together, and with a favorable transfer of loads to the ship structure.

The guide members are preferably frame structures of basically rectangular shape, each provided with transverse braces extending from its lower corners diagonally inwards and carrying transversely acting locking means at the lower corners.

The deck is provided with a series of openings along the rails and the mechanical locking means include vertical studs adapted to fit into selected openings, the cassette having jack-up means facilitating engagement between the studs and the openins.

Each guide member is preferably provided with vertical front and rear cargo unit guides, whereby spaces between two cassettes easily can be adapted to receive containers of optional size. The deck may include longitudinally running, upstanding box structures carrying the rails, and the guide members are preferably projecting partly down between the box structures.

DETAILED DESCRIPTION

Figure 1:
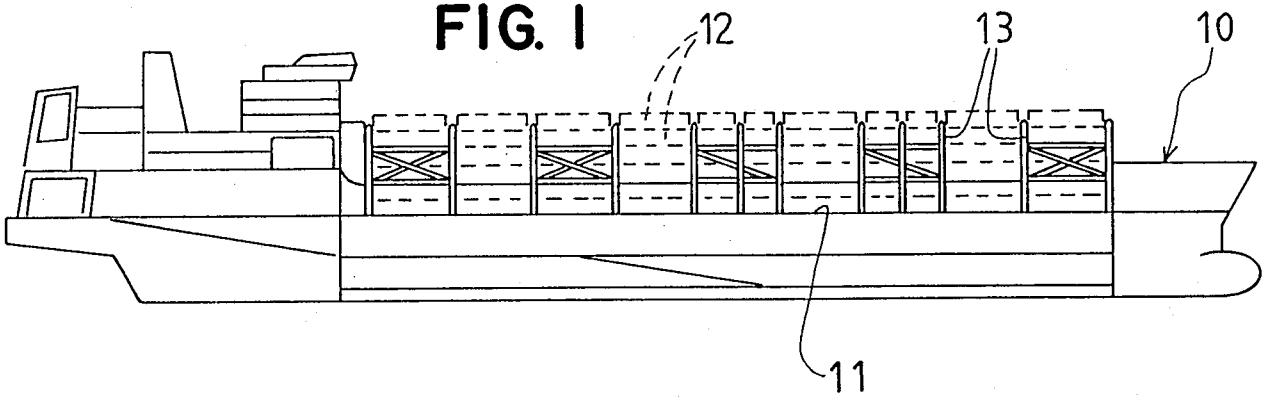
FIG. 1 is a schematic elevational view of a ship having container cassettes upon its weather deck, arranged according to a certain pattern.

The ship 10 according to FIG. 1 is adapted to carry cargo units, or containers, 12 on its weather deck 11. The ship has a number of tween decks, accessible for wheeled vehicles (RoRo), but may also be arranged for stowing containers.

Figure 7:
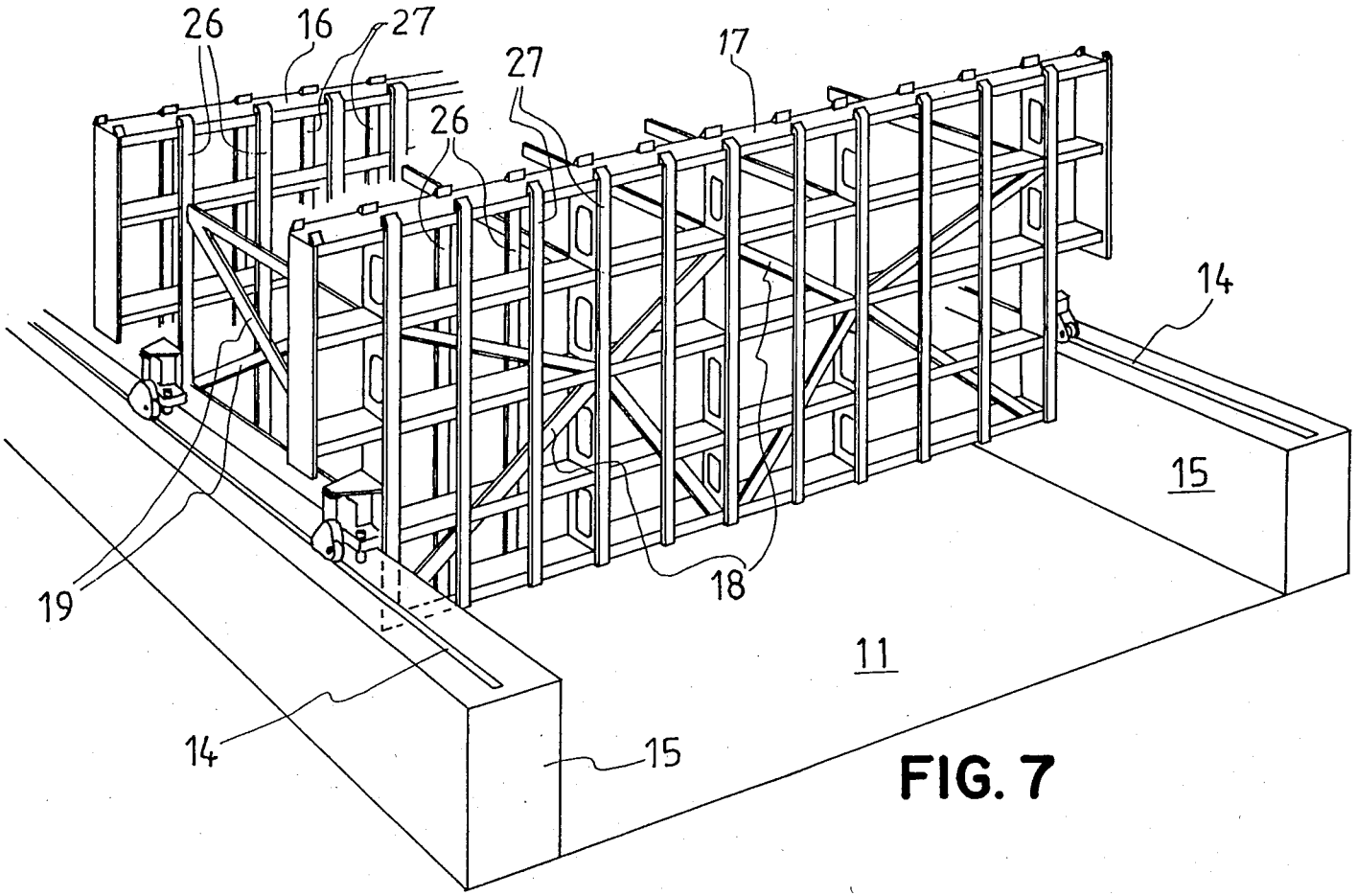
FIG. 7 is a schematic perspective view of a container cassette.
Figure 8:
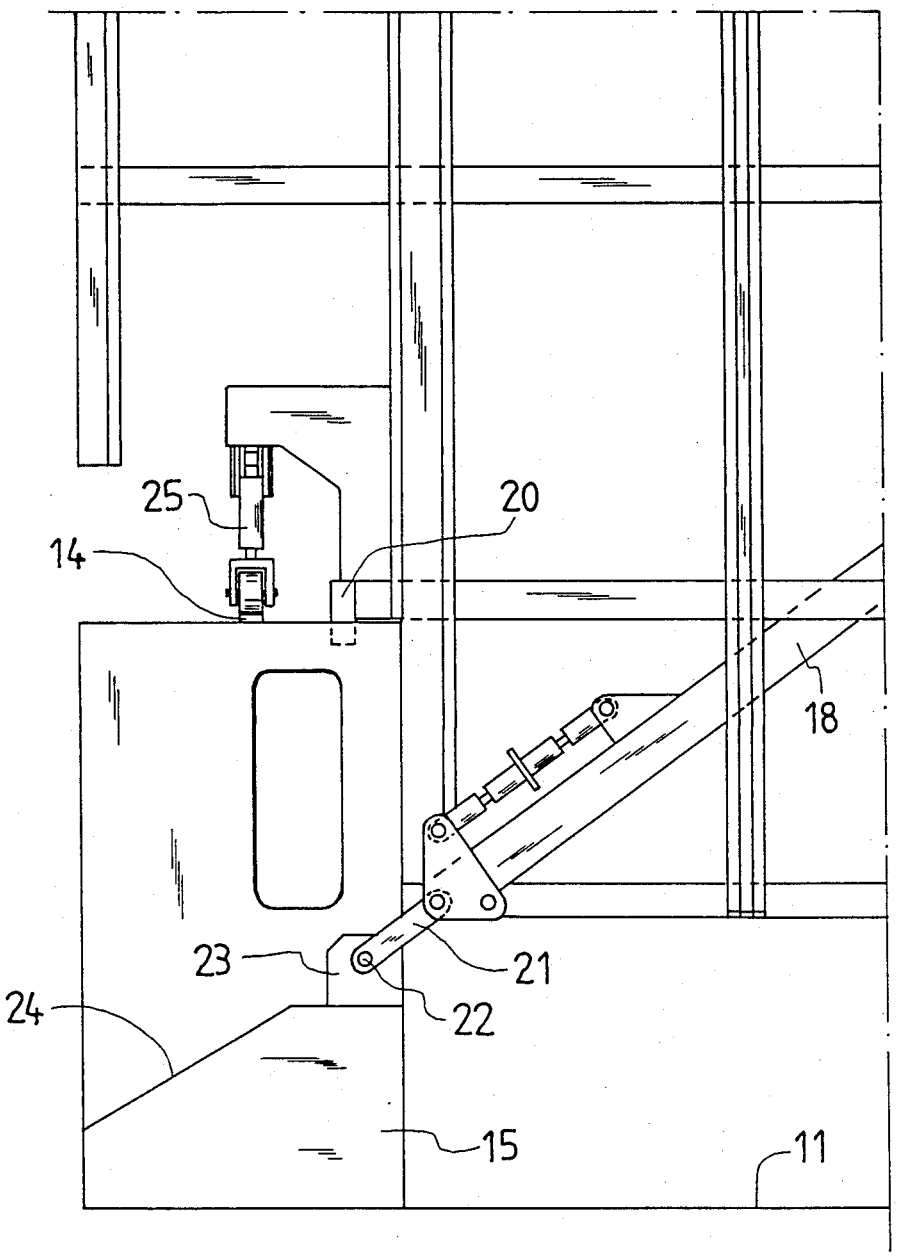
FIG. 8 is a partial end elevational view of a cassette on a larger scale.

A number of container cassettes 13 according to the invention are mounted upon the ship's deck 11. As is best shown in FIG. 7 these cassettes are horizontally movable along rails 14, carried by wheels or other friction reduction devices. The rails are mounted upon longitudinally running box structures 15. These are made of steel plate and form integral parts of the deck structure.

The rails 14 may be fitted directly upon the deck, but the box structures are well suited to take up and distribute the loads from the containers. The fact that the box structures project above the deck, while permitting the lower parts of the cassettes to extend downwards between themselves, provides an increased safety against lateral shifting of the deck load.

A cassette forms a torque resistant unit, stable as to form and designed to support the desired number of containers (six superposed containers in FIG. 1). Each cassette 13 includes one forward and one rearward guide member 16 and 17, respectively, constructed as a basically rectangular framework of vertical and horizontal beams. Transversely directed, diagonal stays 18, within each guide member 16, 17, ensure a satisfactory transverse rigidity.

Two guide members 16, 17 are interconnected by longitudinal beams and stays 19, holding the members apart a distance suitable to receive containers of a certain size, for instance 20′ or 40′, respectively. Transverse strength is improved by beams or stays 19.

The locking of such a cassette in the longitudinal direction of the ship occurs by way of the box structures 15. Studs 20 on the cassettes may be introduced into suitable located openings in the box structures, and will safely locate the cassette in relation to the box structures. The locking of a cassette can obviously, alternatively, or additionally occur by means engaging the deck directly.

At least one stay 18 extends diagonally inwards/upwards from each lower corner of a guide member. A locking device 21, aligned with each of the diagonal stays 18, may be engaged with a bracket 23 by means of a pin 22. The brackets 23 form part of a strengthend base 24, in each box structure.

The guide members extend downwardly between the box structures, which thus will additionally support the cassettes against transverse movements. There is, however, sufficient free space below the guide members to permit the handling of hatch covers of the horizontally sliding type.

When moving a cassette along the rails 14 it is necessary that the engagement at 21, 22, 23 be released, and the guide members be lifted sufficiently to pull the studs 20 out of the openings into which they have been introduced. This occurs by means of hydraulic rams 25 at the wheels at each lower corner of the cassette. The moving of a cassette along the rails may be brought about by arbitrary known devices, for example winches (not shown).

Figure 2:
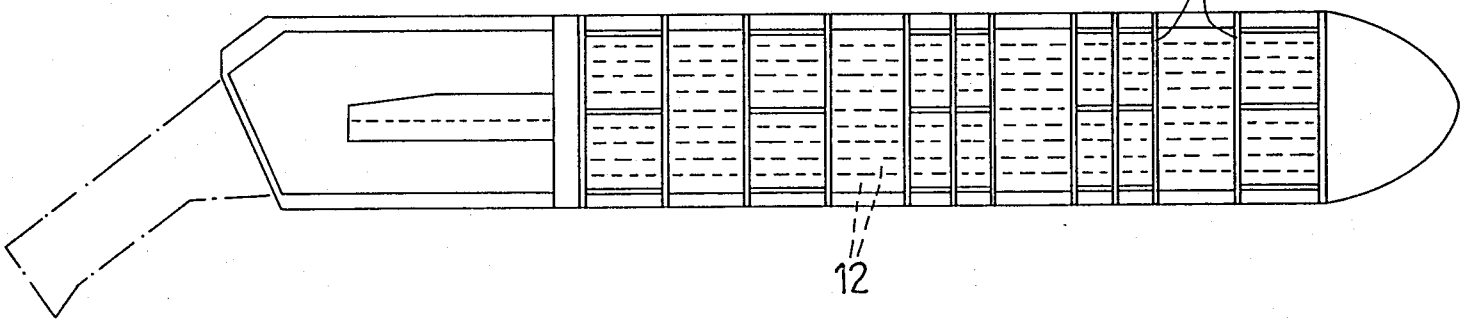
FIG. 2 is a top plan view of the ship as shown in FIG. 1.

FIGS. 1 and 2 show five cassettes 13 mounted upon the deck. Each guide member 16, 17 is provided with vertical guide and support bars 26, 27 on its front, and rear faces, respectively. Each guide member may thus support two stacks of containers, one inside and one outside a cassette.

The cassettes may be differently designed. Those in FIG. 1 having crossed longitudinal stays are intended for one type of container, say 40′ size, while those having a simple diagonal stay and a central guide member will support shorter containers, say two stacks of 20′ size.

Two spaced apart cassettes 13 will by means of their outwardly facing guide bars 27 support an intermediate stack of containers, that may contain 40′ or 20′ containers, depending upon the spacing between the cassettes.

In FIGS. 1 and 2 there are five cassettes of which three are intended for 40′ and two for 20′ containers. The cassettes are spaced apart equal distances, permitting the reception of four further stacks of 40′ containers.

Figure 3:
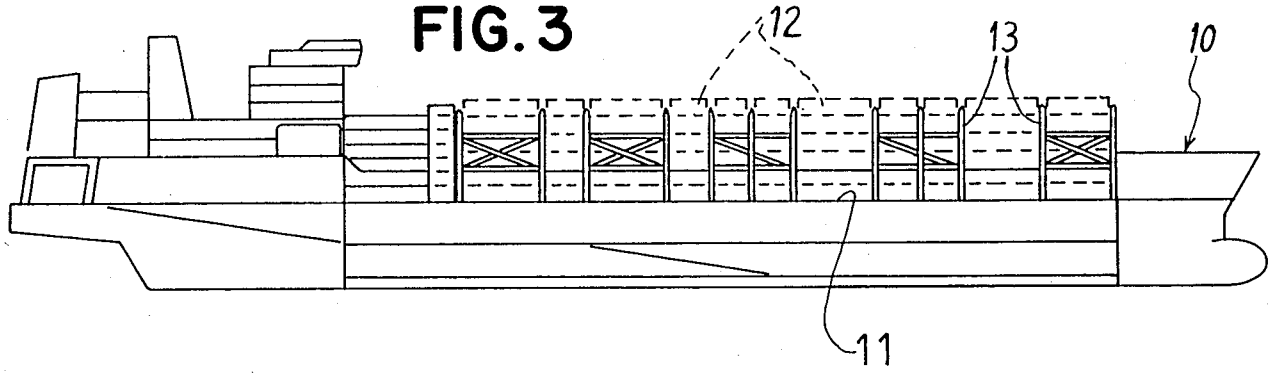
FIG. 3 is a view similar to FIG. 1 of a ship, where the container cassettes are arranged according to a different pattern.
Figure 4:
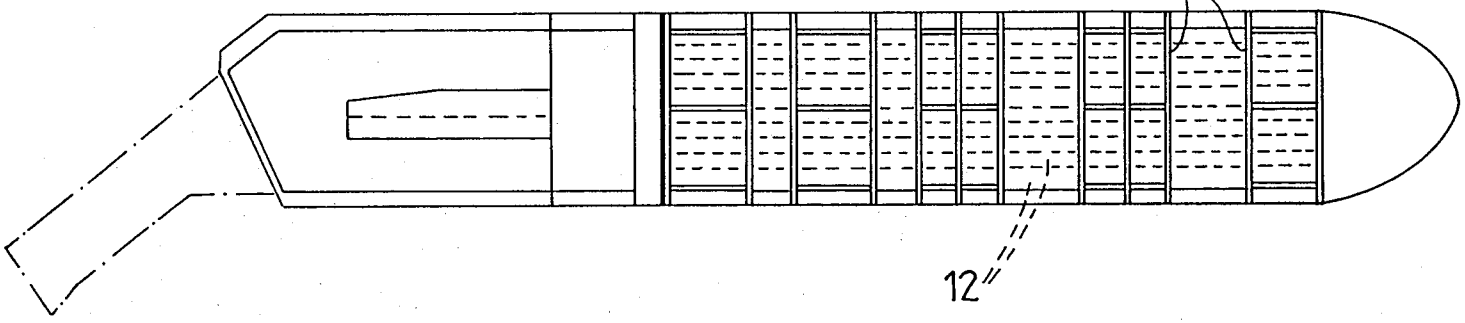
FIG. 4 is a top plan view of the ship as shown in FIG. 3.
Figure 5:
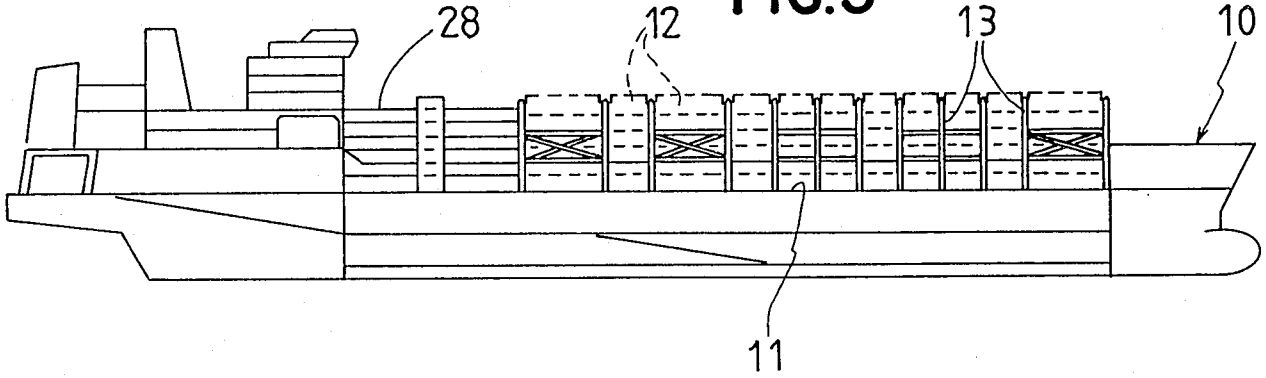
FIG. 5 is a view similar to FIG. 1 showing a further pattern of cassette arrangement.
Figure 6:
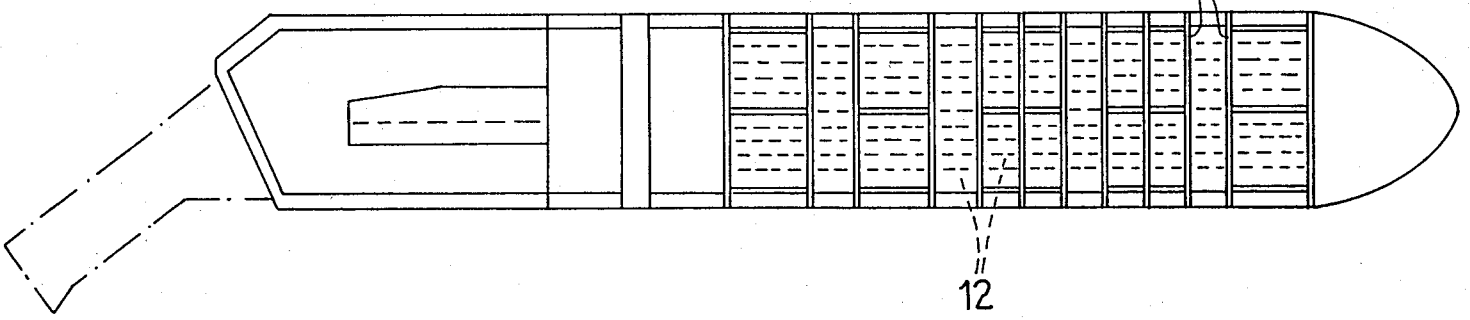
FIG. 6 is a top plan view of the ship of FIG. 5.

In the arrangement according to FIGS. 3 and 4 the spacing between the three rearward cassettes are adapted to receive 20′ containers, and in FIGS. 5 and 6 the spacings between all cassettes are selected to receive 20′ containers only.

The two latter arrangements provide some free deck space, which may be covered by a superstructure 28, housing for example car decks or other stowing facilities.

The cassettes can easily be lifted off the ship by means of a crane, and some, or all cassettes may be substituted by others adapted for different sizes of containers, or for providing increased space for a bigger superstructure 28.

I claim:

1. In a ship having at least one deck for carrying standardized cargo units stacked vertically between spaced-apart, transverse guide members, the improvement comprising:

a plurality of rails on the deck running in the longitudinal direction of the ship;

at least one cargo unit support cassette supported on said rails, each cassette comprising a forward guide member, a rear guide member longitudinally spaced from said forward guide member, and longitudinal stays interconnecting said guide member having a length to space said guide members apart a distance to receive standardized cargo units therebetween, said guide members having front and rear sides; and anti-friction means on said cassette operatively engaging said rails to facilitate movement of said cassette along said longitudinal rails;

each guide member comprising a frame structure of basically rectangular shape, and having transverse braces within each guide member extending from the lower corners of said basically rectangular frame structure diagonally inwards and upwards, and transversely acting releasable locking means mounted on said lower corners releasably engageable with bracket means on said deck for holding said cassette against unintentional movement transverse to and along said rails at any selected position.

2. The improvement as claimed in claim 1 and further comprising:

a further releasable locking means comprising a plurality of spaced vertical openings along said rails and vertical studs on said guide members adapted to fit into selected ones of said openings at any selected position of said cassette; and jack-up means mounted on said cassette for facilitating lowering and raising said studs into and out of said openings.

3. The improvement as claimed in claim 1 and further comprising vertical cargo unit support bars on said front and rear sides of each guide member for guiding and supporting the cargo units.

4. The improvement as claimed in claim 1 and further comprising:

two transversely spaced elongated box structures extending in the longitudinal direction of the ship, one of said rails being on each of said box structures and extending parallel thereto;

each of said guide members having a breadth substantially corresponding to the spacing between said box structures and having a lower portion projecting downwardly between said box structures.

5. The improvement as claimed in claim 4 and further comprising:

a further releasable locking means comprising a plurality of spaced vertical openings in each of said box structures adjacent said rail thereon, and vertical studs on said guide members adapted to fit into selected ones of said openings at any selected position of said cassette; and jack-up means mounted on said cassette for facilitating raising and lowering said studs out of and into said openings.

6. The improvement as claimed in claim 4 and further comprising vertical cargo unit support bars on said front and rear sides of each guide member for guiding and supporting the cargo units.

7. The improvement as claimed in claim 5 and further comprising vertical cargo unit support bars on said front and rear sides of each guide member for guiding and supporting the cargo units.

8. The improvement as claimed in claim 12 and further comprising vertical cargo unit support bars on said front and rear sides of each guide member for guiding and supporting the cargo units.

9. The improvement as claimed in claim 4 wherein said lower portions of said guide members are disposed below said rails.

10. The improvement as claimed in claim 7 wherein said lower portions of said guide members are disposed below said rails.

* * * * *